US010692415B2

(12) United States Patent
Xing et al.

(10) Patent No.: US 10,692,415 B2
(45) Date of Patent: Jun. 23, 2020

(54) GATE DRIVING CIRCUIT OF IRREGULAR SCREEN PANEL AND DRIVING METHOD

(71) Applicant: Wuhan China Star Optoelectronics Technology Co., Ltd., Wuhan (CN)

(72) Inventors: Zhenzhou Xing, Wuhan (CN); Chunhung Huang, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 20 days.

(21) Appl. No.: 16/300,042

(22) PCT Filed: Sep. 12, 2018

(86) PCT No.: PCT/CN2018/105336
§ 371 (c)(1),
(2) Date: Nov. 8, 2018

(87) PCT Pub. No.: WO2019/205429
PCT Pub. Date: Oct. 31, 2019

(65) Prior Publication Data

US 2019/0325801 A1 Oct. 24, 2019

(30) Foreign Application Priority Data

Apr. 24, 2018 (CN) ..... 2018 1 0374875

(51) Int. Cl.
*G09G 3/20* (2006.01)

(52) U.S. Cl.
CPC ..... *G09G 3/20* (2013.01); *G09G 2310/0224* (2013.01); *G09G 2310/0267* (2013.01);
(Continued)

(58) Field of Classification Search
CPC ..... G09G 3/3266
See application file for complete search history.

(56) References Cited

U.S. PATENT DOCUMENTS 8,976,205 B2 * 3/2015 Shin ..... G09G 3/003 345/204
10,074,312 B2 * 9/2018 Yoon ..... G09G 3/3233
(Continued)

FOREIGN PATENT DOCUMENTS

CN 105096891 A 11/2015
CN 105527739 A 4/2016
(Continued)

*Primary Examiner* — Chad M Dicke
(74) *Attorney, Agent, or Firm* — Leong C. Lei

(57) ABSTRACT

Disclosed are a gate driving circuit of an irregular screen panel and a driving method. The gate driving circuit comprises: a first array substrate row driving circuit driving a scan line, which extends from the left side of the notch area to the notch area; a second array substrate row driving circuit driving a scan line, which extends from the right side of the notch area to the notch area; a third array substrate row driving circuit driving a scan line, which extends from the left side of the non-notch area to a right side thereof, and a scan line driven by a fourth array substrate row driving circuit is between adjacent scan lines driven by the third array substrate row driving circuit; the fourth array substrate row driving circuit driving a scan line, which extends from the right side of the non-notch area to the left side thereof.

7 Claims, 5 Drawing Sheets

(52) U.S. Cl.
CPC ..... *G09G 2310/0283* (2013.01); *G09G 2310/0291* (2013.01)

(56) References Cited

U.S. PATENT DOCUMENTS

| | | | | |
|---|---|---|---|---|
| 10,229,650 | B2 * | 3/2019 | Wu | G09G 5/003 |
| 2005/0057477 | A1 * | 3/2005 | Yun | G02F 1/13452 345/93 |
| 2006/0077191 | A1 * | 4/2006 | Ming-Daw | G02F 1/133351 345/204 |
| 2008/0088568 | A1 * | 4/2008 | Haga | G09G 3/18 345/100 |
| 2008/0278467 | A1 * | 11/2008 | Hwang | G09G 3/3648 345/205 |
| 2012/0112988 | A1 * | 5/2012 | Nakanishi | G02F 1/134309 345/76 |
| 2014/0085279 | A1 * | 3/2014 | Shiomi | G09G 3/2074 345/204 |
| 2015/0310827 | A1 * | 10/2015 | Song | G09G 3/2022 345/690 |
| 2016/0019856 | A1 * | 1/2016 | Tanaka | G09G 3/3648 345/206 |
| 2016/0111040 | A1 * | 4/2016 | Kim | G02F 1/13454 345/698 |
| 2017/0352311 | A1 * | 12/2017 | Lee | G09G 3/3225 |
| 2018/0158417 | A1 * | 6/2018 | Xiang | G09G 3/3233 |
| 2018/0174531 | A1 * | 6/2018 | Chen | G09G 3/3648 |
| 2018/0190190 | A1 * | 7/2018 | Xi | G09G 3/3225 |
| 2018/0204889 | A1 * | 7/2018 | Yu | G09G 3/3233 |

FOREIGN PATENT DOCUMENTS

| | | | |
|---|---|---|---|
| CN | 107221281 | A | 9/2017 |
| CN | 107346650 | A | 11/2017 |
| CN | 107481669 | A | 12/2017 |
| CN | 107561806 | A | 1/2018 |
| CN | 207217536 | U | 4/2018 |
| KR | 20070080047 | A | 8/2007 |

* cited by examiner

GATE DRIVING CIRCUIT OF IRREGULAR SCREEN PANEL AND DRIVING METHOD

FIELD OF THE INVENTION

The present invention relates to a display technology field, and more particularly to a gate driving circuit of an irregular screen panel and a driving method.

BACKGROUND OF THE INVENTION

With the rapid development of modern technology, electronic devices are becoming more and more intelligent, especially the intellectualization of mobile phones is significantly prominent. Currently, the design trend of the mobile phone screen is Incell (in-cell touch)+full screen. However, due to the presence of the front camera and handset, the design of the screen digging (notch design) is inevitable, thus resulting in an irregular screen panel. Once adopting the notch design, the notch design will lead to unsmooth alignment of gate lines in the notch areas. Accordingly, it leads to a larger frame width for the notch areas of the screen, and to a fault of process/yield. Please refer to FIG. 1, which is a diagram of a full screen mobile phone on the market. With the notch design, the panel is divided into a notch area and a non-notch area according to the position of the notch.

The driving circuits of the small and medium size panels can be categorized into a gate driver circuit and a source driver circuit. As shown in FIG. 2, which is a diagram of a driving circuit of a small and medium size panel according to the prior art, the driver IC is bonded to the bottom side of the glass panel and is connected to the host through a flexible circuit board assembly (FPCA) to implement the source driver function. The Gate driver circuit is implemented by a GOA circuit, ie, an array substrate row driving circuit (Gate Driver On Array). It can be simply understood as implementing some of the functions of the Gate Driver on the glass panel. Meanwhile, under normal circumstances, the GOA circuits are placed on the left and right sides of the glass panel respectively, and the GOA circuits are driven by means of interlaced driving (the GOA circuit at the left side drives Gate line1/Gate line3/Gate line5 . . . , and the GOA circuit at the right side drives Gate line2/Gate line4/Gate line6 . . . ).

In the Incell+Notch panel, the existence of the notch results in the Gate line detour in the notch area. The frame width of the notch area of the screen panel will be influenced. As shown in FIG. 3, which shows a scan line interlaced driving design scheme of two notch areas according to the prior art. The Gate line design for the notch area according prior art have two categories: 1, as shown in the left side of FIG. 3, the Gate line detour for the notch area is directly implemented in the GE layer (Gate layer). The disadvantage of this method is that the length of the line in the GE layer is too long and it is prone to line injury/damage. 2, as shown in the right side of FIG. 3, the perforation to the SD layer (Source layer) is used for the Gate line detour in the notch area. The disadvantage of this method is that the perforation to the SD layer is required, which will results in process complication/yield reduction.

SUMMARY OF THE INVENTION

An objective of the present invention is to provide a gate driving circuit of an irregular screen panel and a driving method to reduce the frame width at the notch area.

For realizing the aforesaid objectives, the present invention provides a gate driving circuit of an irregular screen panel, comprising:

a first array substrate row driving circuit, located on a left side of a notch area of the panel for driving a scan line from the left side of the notch area, and the driven scan line extends from the left side of the notch area to the notch area;

a second array substrate row driving circuit, located on a right side of the notch area of the panel for driving a scan line from the right side of the notch area, and the driven scan line extends from the right side of the notch area to the notch area;

a third array substrate row driving circuit, located on a left side of a non-notch area of the panel for driving a scan line from the left side of the non-notch area, and the driven scan line extends from the left side of the non-notch area to a right side of the non-notch area, and a scan line driven by a fourth array substrate row driving circuit is between adjacent scan lines driven by the third array substrate row driving circuit;

the fourth array substrate row driving circuit, located on the right side of the non-notch area of the panel for driving a scan line from the right side of the non-notch area, and the driven scan line extends from the right side of the non-notch area to the left side of the non-notch area, and a scan line driven by the third array substrate row driving circuit is between adjacent scan lines driven by the fourth array substrate row driving circuit;

as the panel displays, the first array substrate row driving circuit and the second array substrate row driving circuit drive the scan lines of the panel having the notch area by means of dual side drive progressive scan, and the third array substrate row driving circuit and the fourth array substrate row driving circuit drive the scan lines of the panel having the non-notch area by means of dual side drive interlaced scan.

The third array substrate row driving circuit comprises array substrate row driving units of odd-numbered stages which are cascade coupled, and the fourth array substrate row driving circuit comprises array substrate row driving units of even-numbered which are cascade coupled, and an array substrate row driving unit of each stage correspondingly drives a scan line of one row; or the third array substrate row driving circuit comprises array substrate row driving units of even-numbered stages which are cascade coupled, and the fourth array substrate row driving circuit comprises array substrate row driving units of odd-numbered which are cascade coupled, and an array substrate row driving unit of each stage correspondingly drives a scan line of one row.

In case that the array substrate row driving unit of a current stage is for an Nth stage, and the array substrate row driving unit of the Nth comprises: a forward and reverse scan control module, a control input module, a latch module, a reset module, a NAND gate signal processing module, an output buffer module, a first inverter and second inverter;

the forward and reverse scan control module comprises a first transmission gate and a second transmission gate; an input end of the first transmission gate is coupled to a first node of the array substrate row driving unit of an N−2th stage, and an output end of the first transmission gate is coupled to a second node in the current stage, and a high potential control end of the first transmission gate is coupled to a first direction scan signal, and a low potential control end of the first transmission gate is coupled to a second direction scan signal; an input end of the second transmission gate is coupled to a first node of the array substrate row driving unit of an N+2th stage, and an output end of the second transmission gate is coupled to the second node in the current stage, and a high potential control end of the second transmission gate is coupled to the second direction scan signal, and a low potential control end of the second transmission gate is coupled to the first direction scan signal;

the control input module comprises a clock control inverter, and a low potential control end of the clock control inverter is coupled to the second node in the current stage, and a high potential control end of the clock control inverter is coupled to a first node in the current stage, and the output end of the clock control inverter is coupled to a third node in the current stage, and an input end of the clock control inverter is coupled to an output end of the first inverter;

the latch module comprises a seventh thin film transistor and an eighth thin film transistor of P-type, and a ninth thin film transistor and a tenth thin film transistor of N-type; a gate of the seventh thin film transistor is coupled to the first node in the current stage, and a source of the seventh thin film transistor is coupled to a drain of the eighth thin film transistor, and a drain of the seventh thin film transistor is coupled to the third node in the current stage; a gate of the eighth thin film transistor is coupled to a first clock signal, and a source of the eighth thin film transistor is coupled to a constant high potential; a gate of the ninth thin film transistor is coupled to the second node in the current stage, and a source of the ninth thin film transistor is coupled to a constant low potential, and a drain of the ninth thin film transistor is coupled to a source of the tenth thin film transistor; a gate of the tenth thin film transistor is coupled to the first clock signal, and a drain of the tenth thin film transistor is coupled to the third node in the current stage;

the reset module is coupled to the third node of current stage for resetting a potential thereof;

a first input end of the NAND gate signal processing module is coupled to the first node in the current stage, and a second input end of the NAND gate signal processing module is coupled to a second clock signal, and an output end of the NAND gate signal processing module is coupled to an input end of the output buffer module;

an output end of the output buffer module outputs a row scan signal of the current stage;

an input end of the first inverter is coupled to the first clock signal, and the output end of the first inverter is coupled to an input end of the input module;

an input end of the second inverter is coupled to the third node in the current stage, and an output end of the second inverter is coupled to the first node in the current stage.

The reset module comprises a sixth thin film transistor of P-type, and a gate of the sixth thin film transistor is coupled to a reset signal, and a source of the sixth thin film transistor is coupled to the constant high potential, and a drain of the sixth thin film transistor is coupled to the third node in the current stage.

The output buffer module comprises odd number of inverters coupled in series.

The output buffer module comprises three inverters coupled in series.

The control input module comprises a fourth thin film transistor and a fifth thin film transistor of P-type, and an eleventh thin film transistor and a twelfth thin film transistor of N-type; a gate of the fourth thin film transistor is coupled to the second node in the current stage, and a source of the fourth thin film transistor is coupled to constant high potential, and a drain of the fourth thin film transistor is coupled to a source of the fifth thin film transistor; a gate of the fifth thin film transistor is coupled to the output end of the first inverter, and a drain of the fifth thin film transistor is coupled to the third node in the current stage; a gate of the eleventh thin film transistor is coupled to the output end of the first inverter, and a drain of the eleventh thin film transistor is coupled to the third node in the current stage, and a source of the eleventh thin film transistor is coupled to a drain of the twelfth thin film transistor; a gate of the twelfth thin film transistor is coupled to the first node in the current stage, and a source of the twelfth thin film transistor is coupled to the constant low potential.

The NAND signal processing module comprises a nineteenth thin film transistor and a twentieth thin film transistor of P-type, and a twenty-first thin film transistor and a twenty-second thin film transistor of N-type; a gate of the nineteenth thin film transistor is coupled to the second clock signal, and a source of the nineteenth thin film transistor is coupled to the constant high potential, and a drain of the nineteenth thin film transistor is coupled to the input of the output buffer module; a gate of the twentieth thin film transistor is coupled to the first node in the current stage, and a source of the twentieth thin film transistor is coupled to the constant high potential, and a drain of the twentieth thin film transistor is coupled to the input of the output buffer module; a gate of the twenty-first thin film transistor is coupled to the second clock signal, and a drain of the twenty-first thin film transistor is coupled to the input end of the output buffer module, and a source of the twenty-first thin film transistor is coupled to a drain of the twenty-second thin film transistor; a gate of the twenty-second thin film transistor is coupled to the first node in the current stage, and a source of the twenty-second thin film transistor is coupled to the constant low potential.

The first clock signal and the second clock signal have a same period, and a phase difference of the first clock signal and the second clock signal is a half period.

The present invention further provides a driving method of the aforesaid gate driving circuit of the irregular screen panel, comprising:

in a stage of driving the scan lines of the panel having the notch area, the scan lines of the panel having the notch area are driven by means of dual side drive progressive scan, and simultaneously driving the scan line extending from the left side of the notch area to the notch area and the corresponding scan line extending from the right side of the notch area to the notch area;

in a stage of driving the scan lines of the panel having the non-notch area, the scan lines of the panel having the non-notch area are driven by means of dual side drive interlaced scan;

as driving the panel, first accomplishing the stage of driving the scan lines of the panel having the notch area, and then entering the stage of driving the scan lines of the panel having the non-notch area; or as driving the panel, first accomplishing the stage of driving the scan lines of the panel having the non-notch area, and then entering the stage of driving the scan lines of the panel having the notch area.

In conclusion, the gate driving circuit of the irregular screen panel and the driving method can reduce a frame width at the notch area of screen to simplify the process and to improve the product yield.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

Figure 1:
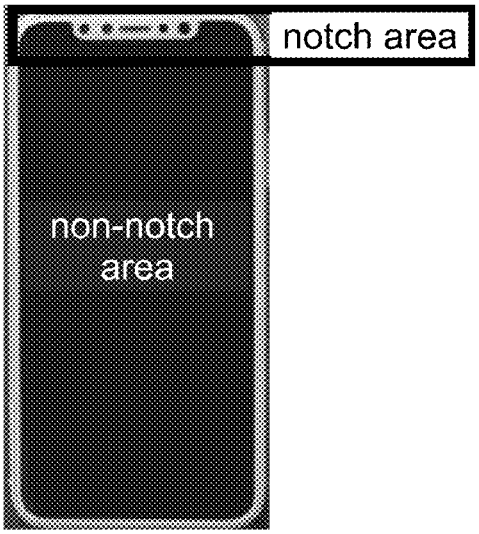
FIG. 1 is a diagram of a full screen mobile phone on the market.
Figure 2:
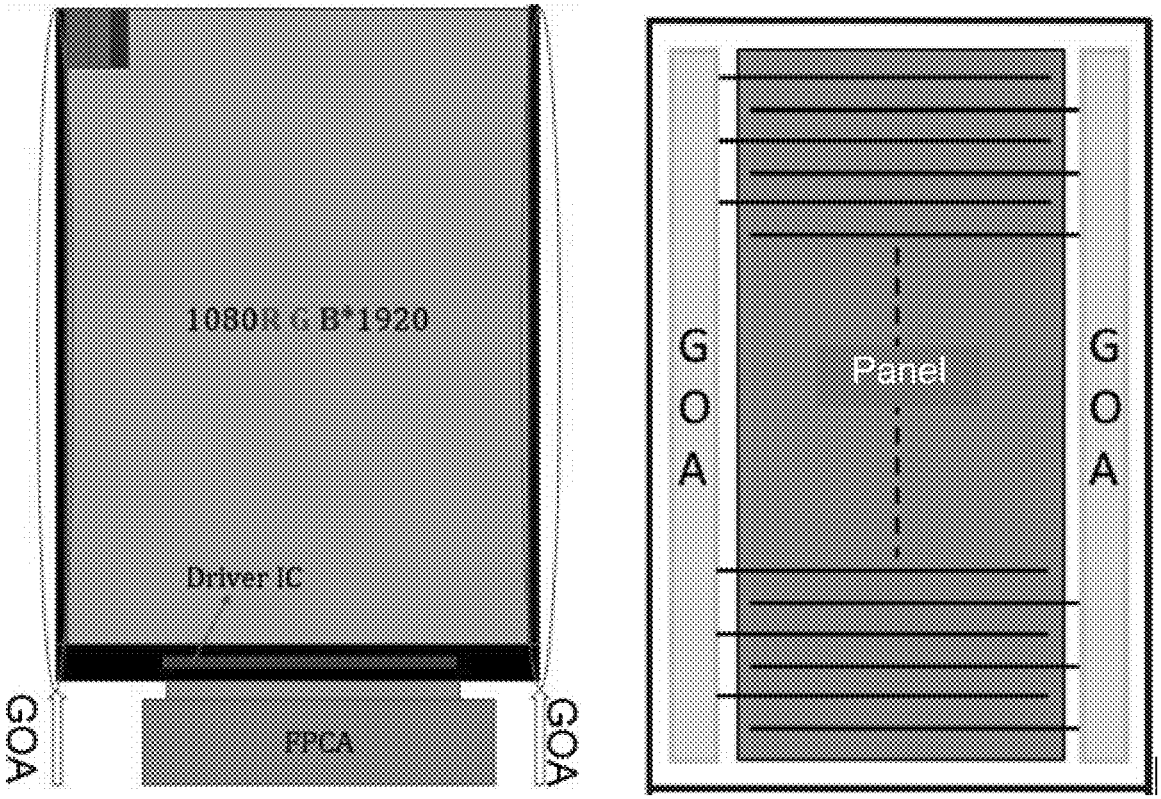
FIG. 2 is a diagram of a driving circuit of a small and medium size panel according to the prior art.
Figure 3:
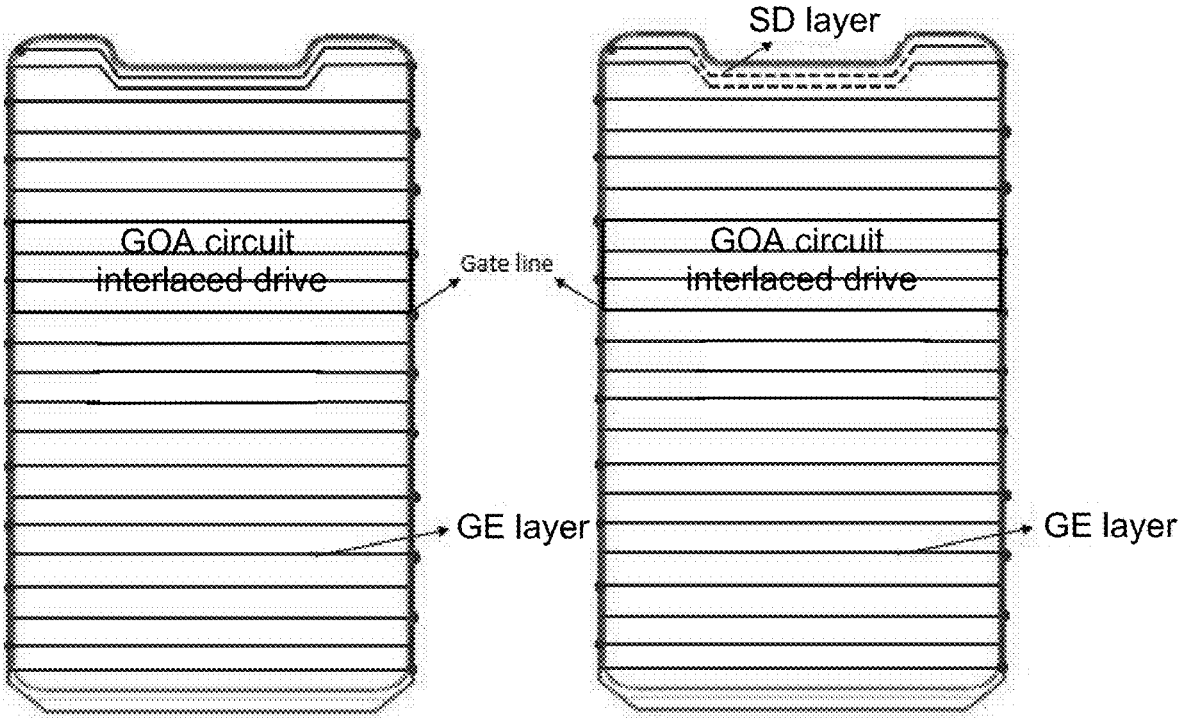
FIG. 3 is a diagram of a scan line interlaced driving design scheme of two notch areas according to the prior art.
Figure 4:
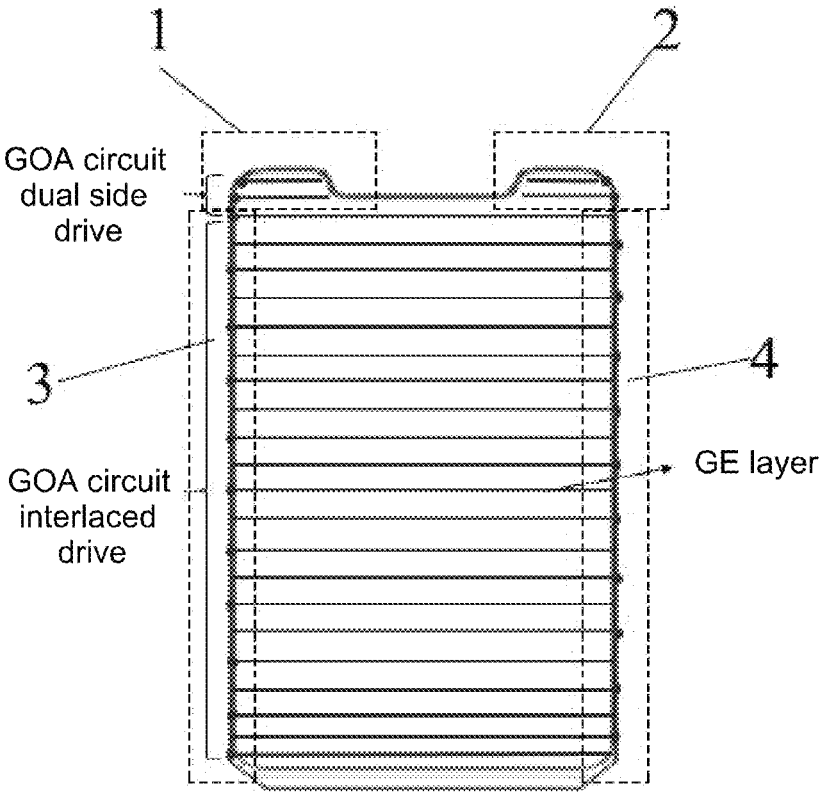
FIG. 4 is a diagram of a driving method of a gate driving circuit of an irregular screen panel according to one preferred embodiment of the present invention.

FIG. 4 is a diagram of a driving method of a gate driving circuit of an irregular screen panel according to one preferred embodiment of the present invention. The gate driving circuit of the irregular screen panel according to the present invention mainly comprises:

a first gate driver on array (GOA) circuit 1, located on a left side of a notch area of the panel (irregular screen panel) for driving a scan line from the left side of the notch area, and the driven scan line extends from the left side of the notch area to the notch area;

a second gate driver on array (GOA) circuit 2, located on a right side of a notch area of the panel (irregular screen panel) for driving a scan line from the right side of the notch area, and the driven scan line extends from the right side of the notch area to the notch area;

a third gate driver on array (GOA) circuit 3, located on a left side of a non-notch area of the panel for driving a scan line from the left side of the non-notch area, and the driven scan line extends from the left side of the non-notch area to a right side of the non-notch area, and a scan line driven by a fourth gate driver on array (GOA) circuit 4 is between adjacent scan lines driven by the third gate driver on array (GOA) circuit;

the fourth gate driver on array (GOA) circuit 4, located on the right side of the non-notch area of the panel for driving a scan line from the right side of the non-notch area, and the driven scan line extends from the right side of the non-notch area to the left side of the non-notch area, and a scan line driven by the third gate driver on array (GOA) circuit 3 is between adjacent scan lines driven by the fourth gate driver on array (GOA) circuit;

as the panel displays, the first GOA circuit 1 and the second GOA circuit 2 drive the scan lines of the panel having the notch area by means of dual side drive progressive scan, and the third GOA circuit 3 and the fourth GOA circuit 4 drive the scan lines of the panel having the non-notch area by means of dual side drive interlaced scan.

According to the GOA circuit of the aforesaid preferred embodiment, the present invention further provides a corresponding driving method of the aforesaid gate driving circuit of the irregular screen panel, mainly comprising:

in a stage of driving the scan lines of the panel having the notch area, the scan lines of the panel having the notch area are driven by means of dual side drive progressive scan, and simultaneously driving the scan line extending from the left side of the notch area to the notch area and the corresponding scan line extending from the right side of the notch area to the notch area;

in a stage of driving the scan lines of the panel having the non-notch area, the scan lines of the panel having the non-notch area are driven by means of dual side drive interlaced scan;

as driving the panel, for the same frame depending on the driving direction, it is an option of first accomplishing the stage of driving the scan lines of the panel having the notch area, and then accomplishing the stage of driving the scan lines of the panel having the non-notch area; or as driving the panel, it is another option of first accomplishing the stage of driving the scan lines of the panel having the non-notch area, and then accomplishing the stage of driving the scan lines of the panel having the notch area.

In the present invention, the GOA circuit of the incell+ notch panel is designed into two parts. Namely, the GOA circuits with the non-notch area are designed to be driven by means of interlaced drive, i.e. means of dual side drive interlaced scan (scanning one line and skipping one line). The GOA circuits with the notch area are designed to be driven by means of left and right dual side drive, i.e. means of dual side drive progressive scan (scanning line by line). Such design does not have the problem of scan line detour, which reduces the frame width at the notch area of the screen; the design also avoids the problems, such as perforation of the scan line and line injury. Thus, the process is simplified and the product yield is improved.

The first GOA circuit 1 and the second GOA circuit 2 have the same sequence, and can adopt a general GOA circuit structure. The GOA units of the same stage at the left and right sides simultaneously and respectively drive the scan lines of the same row corresponding to themselves.

The third GOA circuit 3 and the fourth GOA circuit 4 for the non-notch area are designed to be driven by means of interlaced drive, i.e. by means of dual side drive interlaced scan. The third GOA circuit 3 and the fourth GOA circuit 4 are respectively at left, right two sides of display panel, and the GOA circuit of one side only comprises the GOA units of odd stages, and the GOA circuit of the other side only comprises GOA units of even stages. The sequences of the GOA circuits at two sides are different. The GOA units of respective stages at one side perform the progressive scan to the pixels of odd rows; the GOA units of respective stages at the other side perform the progressive scan to the pixels of even rows.

Figure 5:
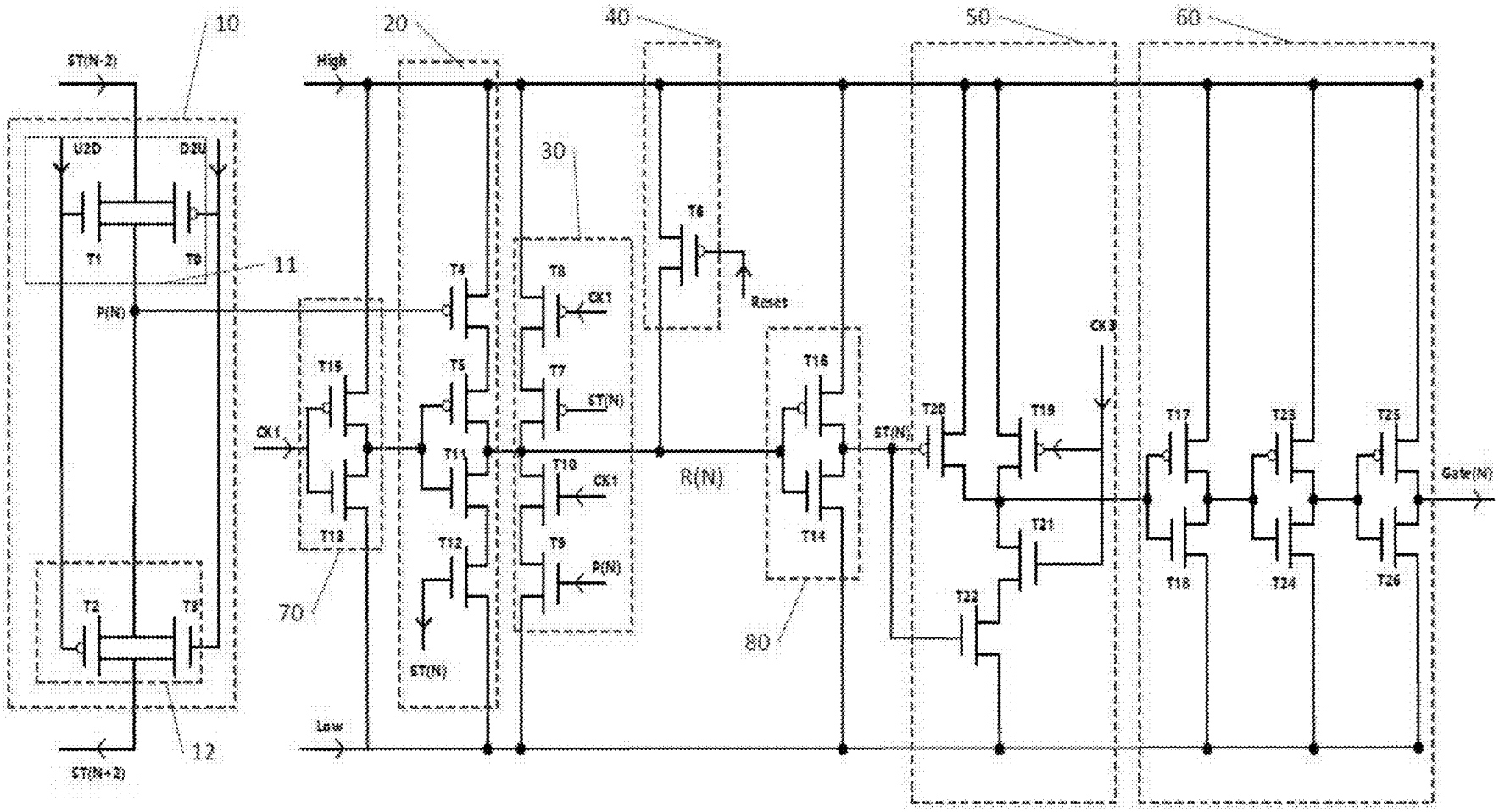
FIG. 5 is a diagram of a gate driver on array (GOA) circuit of a non-notch area in a gate driving circuit of an irregular screen panel according to one preferred embodiment of the present invention.
Figure 6:
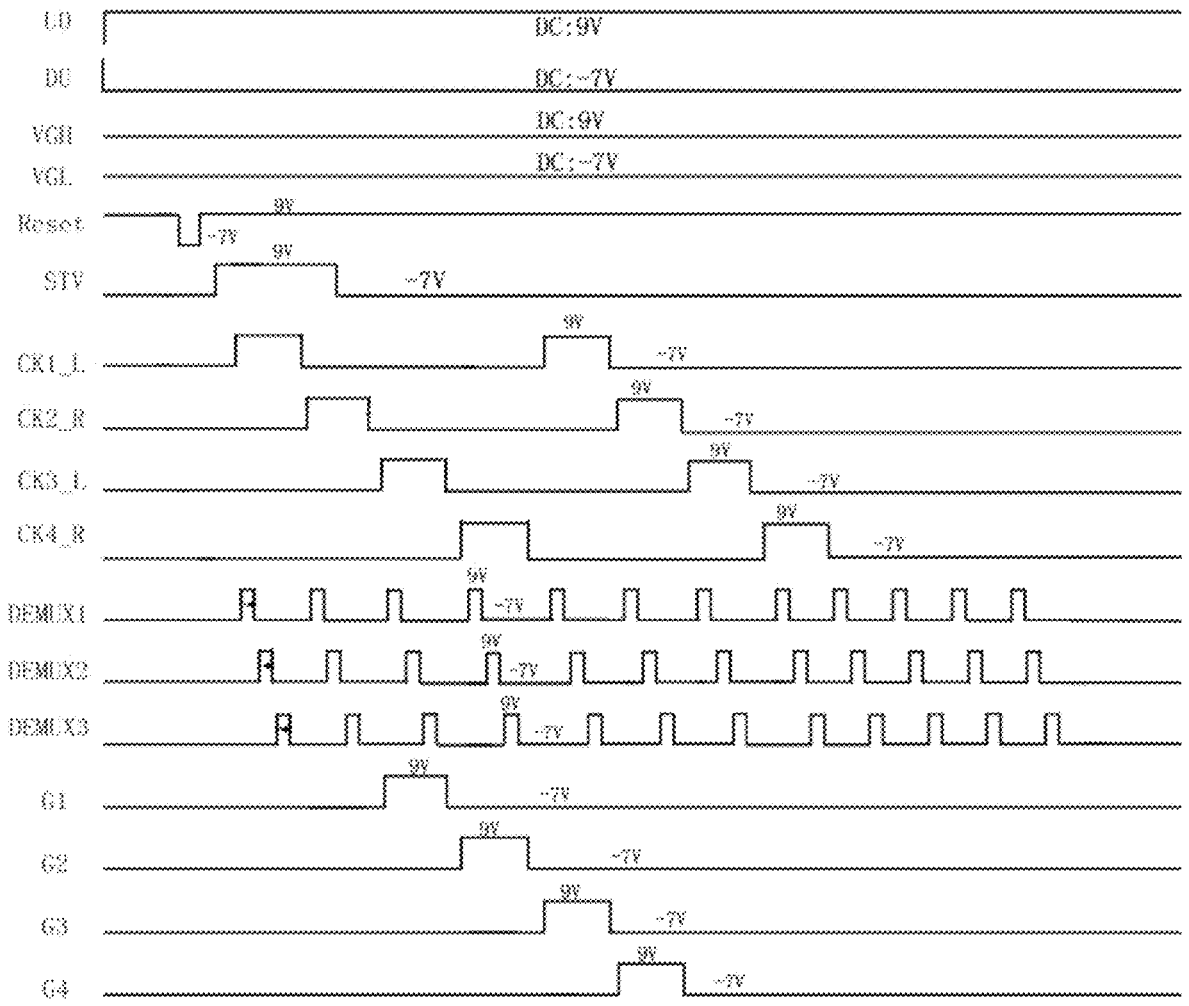
FIG. 6 is a driving reference sequence diagram of the gate driver on array (GOA) circuit shown in FIG. 5.

Please refer to FIG. 5 and FIG. 6. FIG. 5 is a diagram of a gate driver on array (GOA) circuit of a non-notch area in a gate driving circuit of an irregular screen panel according to one preferred embodiment of the present invention. FIG. 6 is a driving reference sequence diagram of the gate driver on array (GOA) circuit shown in FIG. 5. The third GOA circuit 3 and the fourth GOA circuit 4 respectively comprise GOA units of odd stages and GOA units of even stages. In case that the GOA unit of the current stage is for the Nth stage. The GOA unit of the Nth mainly comprises: a forward and reverse scan control module 10, a control input module 20, a latch module 30, a reset module 40, a NAND gate signal processing module 50, an output buffer module 60, a first inverter 70 and second inverter 80.

The forward and reverse scan control module 10 comprises a first transmission gate 11 and a second transmission gate 12; an input end of the first transmission gate 11 is coupled to a node ST(N−2) of the GOA unit of an N−2th stage, and an output end of the first transmission gate is coupled to a node P(n) in the current stage, and a high potential control end of the first transmission gate is coupled to a direction scan signal U2D, and a low potential control end of the first transmission gate is coupled to a direction scan signal D2U; an input end of the second transmission gate 12 is coupled to a node ST(N+2) of the GOA unit of an N+2th stage, and an output end of the second transmission gate is coupled to the node P(N) in the current stage, and a high potential control end of the second transmission gate is coupled to the direction scan signal D2U, and a low potential control end of the second transmission gate is coupled to the direction scan signal U2D; the transmission gate 11 comprises T1 and T0 in parallel, and the transmission gate 12 comprises T2 and T3 in parallel. The transmission gate switches are controlled by the scan signals U2D and D2U having the opposite directions, and the signals at the nodes ST(N−2) or ST(N+2) are selected to be inputted into the node P(N).

The control input module 20 comprises a clock control inverter composed of thin film transistors T4, T5, T11 and T12, and a low potential control end of the clock control inverter is coupled to the node P(N) in the current stage, and a high potential control end of the clock control inverter is coupled to a node ST(N) in the current stage, and the output end of the clock control inverter is coupled to a node R(N) in the current stage, and an input end of the clock control inverter is coupled to an output end of the first inverter 70; by controlling the output signals of the node P(N), the node ST(N) and the first inverter 70, the control input module 20 outputs the signal of the node R(N).

The latch module 30 mainly comprises thin film transistors T7, T8, T9 and T10, and can latch the signal of the node R(N) in the current stage.

The reset module 40 comprise a thin film transistor T6 of P type, and a gate of T6 is coupled to a reset signal Reset, and a source of T6 is coupled to the constant high potential High, and a drain of T6 is coupled to the node R(N) in the current stage for resetting the potential thereof.

The NAND signal processing module 50 mainly comprises thin film transistors T19, T20, T21 and T22. A first input end of the NAND gate signal processing module 50 is coupled to the node ST(N) in the current stage, and a second input end of the NAND gate signal processing module is coupled to a clock signal CK3, and an output end of the NAND gate signal processing module is coupled to an input end of the output buffer module 60; the NAND signal processing module 50 outputs a signal to the buffer module 60 by processing the signals of the clock signal CK3 and the node ST(N) in the current stage.

The output buffer module 60 is used to increase the driving capability, and the output end of the output buffer module outputs a row scan signal Gate(N) of the current stage; the output buffer module comprises odd number of inverters coupled in series. In this embodiment, the output buffer module specifically comprises three inverters coupled in series, which respectively comprise transistors T17 and T18, transistors T23 and T24, and transistors T25 and T26.

An input end of the inverter 70 is coupled to the clock signal CK1, and the output end of the first inverter is coupled to an input end of the control input module 20; the inverter 70 comprises thin film transistors T15 AND T13.

An input end of the inverter 80 is coupled to the node R(N) in the current stage, and an output end of the second inverter is coupled to the node ST(N) in the current stage. The inverter 80 comprises thin film transistors T16 and T14.

With combination of FIG. 6, STV is a start signal corresponding to the signals ST(N−2)/ST(N+2). According to the scan direction, the start signal STV is inputted to the GOA unit of the first stage or the last stage; the signals U2D(UD)/D2U(DU) are forward and reverse scan signals, and have the opposite potentials; the signals CK (CK1_L, CK2_R, CK3_L and CK4_R) are the row start signals; the signal Reset is a panel reset signal; the signals VGH/VGL correspond to High/Low signals.

Since means of dual side drive interlaced scan is adopted, the clock signals CK1_L and CK3_L are required to be inputted for the first GOA circuit 3 or the fourth GOA circuit 4 at one side of the panel. The clock signals CK1_L and CK3_L have the same period, and a phase difference is a half period. For the first GOA circuit 3 or the fourth GOA circuit 4 at the other side of the panel, the clock signals CK2_R and CK4_R are required to be inputted. The clock signals CK2_R and CK4_R have the same period, and a phase difference is a half period; the clock signals CK1_L, CK2_R, CK3_L and CK4_R have the same period, and a phase difference is a quarter period.

In conclusion, the gate driving circuit of the irregular screen panel and the driving method can reduce a frame width at the notch area of screen to simplify the process and to improve the product yield.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A gate driving circuit of an irregular screen panel, comprising:

a first array substrate row driving circuit, located on a left side of a notch area of the panel for driving a scan line from the left side of the notch area, and the driven scan line extends from the left side of the notch area to the notch area;

a second array substrate row driving circuit, located on a right side of the notch area of the panel for driving a scan line from the right side of the notch area, and the driven scan line extends from the right side of the notch area to the notch area;

a third array substrate row driving circuit, located on a left side of a non-notch area of the panel for driving a scan line from the left side of the non-notch area, and the driven scan line extends from the left side of the non-notch area to a right side of the non-notch area, and a scan line driven by a fourth array substrate row driving circuit is between adjacent scan lines driven by the third array substrate row driving circuit;

the fourth array substrate row driving circuit, located on the right side of the non-notch area of the panel for driving a scan line from the right side of the non-notch area, and the driven scan line extends from the right side of the non-notch area to the left side of the non-notch area, and a scan line driven by the third array substrate row driving circuit is between adjacent scan lines driven by the fourth array substrate row driving circuit;

as the panel displays, the first array substrate row driving circuit and the second array substrate row driving circuit drive the scan lines of the panel having the notch area by means of dual side drive progressive scan, and the third array substrate row driving circuit and the fourth array substrate row driving circuit drive the scan lines of the panel having the non-notch area by means of dual side drive interlaced scan;

wherein the third array substrate row driving circuit comprises array substrate row driving units of odd-numbered stages which are cascade coupled, and the fourth array substrate row driving circuit comprises array substrate row driving units of even-numbered which are cascade coupled, and an array substrate row driving unit of each stage correspondingly drives a scan line of one row; or the third array substrate row driving circuit comprises array substrate row driving units of even-numbered stages which are cascade coupled, and the fourth array substrate row driving circuit comprises array substrate row driving units of odd-numbered which are cascade coupled, and an array substrate row driving unit of each stage correspondingly drives a scan line of one row;

wherein in case that the array substrate row driving unit of a current stage is for an Nth stage, and the array substrate row driving unit of the Nth comprises: a forward and reverse scan control module, a control input module, a latch module, a reset module, a NAND gate signal processing module, an output buffer module, a first inverter and second inverter;

the forward and reverse scan control module comprises a first transmission gate and a second transmission gate; an input end of the first transmission gate is coupled to a first node of the array substrate row driving unit of an N−2th stage, and an output end of the first transmission gate is coupled to a second node in the current stage, and a high potential control end of the first transmission gate is coupled to a first direction scan signal, and a low potential control end of the first transmission gate is coupled to a second direction scan signal; an input end of the second transmission gate is coupled to a first node of the array substrate row driving unit of an N+2th stage, and an output end of the second transmission gate is coupled to the second node in the current stage, and a high potential control end of the second transmission gate is coupled to the second direction scan signal, and a low potential control end of the second transmission gate is coupled to the first direction scan signal;

the control input module comprises a clock control inverter, and a low potential control end of the clock control inverter is coupled to the second node in the current stage, and a high potential control end of the clock control inverter is coupled to a first node in the current stage, and the output end of the clock control inverter is coupled to a third node in the current stage, and an input end of the clock control inverter is coupled to an output end of the first inverter;

the latch module comprises a seventh thin film transistor and an eighth thin film transistor of P-type, and a ninth thin film transistor and a tenth thin film transistor of N-type; a gate of the seventh thin film transistor is coupled to the first node in the current stage, and a source of the seventh thin film transistor is coupled to a drain of the eighth thin film transistor, and a drain of the seventh thin film transistor is coupled to the third node in the current stage; a gate of the eighth thin film transistor is coupled to a first clock signal, and a source of the eighth thin film transistor is coupled to a constant high potential; a gate of the ninth thin film transistor is coupled to the second node in the current stage, and a source of the ninth thin film transistor is coupled to a constant low potential, and a drain of the ninth thin film transistor is coupled to a source of the tenth thin film transistor; a gate of the tenth thin film transistor is coupled to the first clock signal, and a drain of the tenth thin film transistor is coupled to the third node in the current stage;

the reset module is coupled to the third node of current stage for resetting a potential thereof;

a first input end of the NAND gate signal processing module is coupled to the first node in the current stage, and a second input end of the NAND gate signal processing module is coupled to a second clock signal, and an output end of the NAND gate signal processing module is coupled to an input end of the output buffer module;

an output end of the output buffer module outputs a row scan signal of the current stage;

an input end of the first inverter is coupled to the first clock signal, and the output end of the first inverter is coupled to an input end of the input module;

an input end of the second inverter is coupled to the third node in the current stage, and an output end of the second inverter is coupled to the first node in the current stage.

2. The gate driving circuit of the irregular screen panel according to claim 1, wherein the reset module comprises a sixth thin film transistor of P-type, and a gate of the sixth thin film transistor is coupled to a reset signal, and a source of the sixth thin film transistor is coupled to the constant high potential, and a drain of the sixth thin film transistor is coupled to the third node in the current stage.

3. The gate driving circuit of the irregular screen panel according to claim 1, wherein the output buffer module comprises odd number of inverters coupled in series.

4. The gate driving circuit of the irregular screen panel according to claim 3, wherein the output buffer module comprises three inverters coupled in series.

5. The gate driving circuit of the irregular screen panel according to claim 1, wherein the control input module comprises a fourth thin film transistor and a fifth thin film transistor of P-type, and an eleventh thin film transistor and a twelfth thin film transistor of N-type; a gate of the fourth thin film transistor is coupled to the second node in the current stage, and a source of the fourth thin film transistor is coupled to constant high potential, and a drain of the fourth thin film transistor is coupled to a source of the fifth thin film transistor; a gate of the fifth thin film transistor is coupled to the output end of the first inverter, and a drain of the fifth thin film transistor is coupled to the third node in the current stage; a gate of the eleventh thin film transistor is coupled to the output end of the first inverter, and a drain of the eleventh thin film transistor is coupled to the third node in the current stage, and a source of the eleventh thin film transistor is coupled to a drain of the twelfth thin film transistor; a gate of the twelfth thin film transistor is coupled to the first node in the current stage, and a source of the twelfth thin film transistor is coupled to the constant low potential.

6. The gate driving circuit of the irregular screen panel according to claim 1, wherein the NAND signal processing module comprises a nineteenth thin film transistor and a twentieth thin film transistor of P-type, and a twenty-first thin film transistor and a twenty-second thin film transistor of N-type; a gate of the nineteenth thin film transistor is coupled to the second clock signal, and a source of the nineteenth thin film transistor is coupled to the constant high potential, and a drain of the nineteenth thin film transistor is coupled to the input of the output buffer module; a gate of the twentieth thin film transistor is coupled to the first node in the current stage, and a source of the twentieth thin film transistor is coupled to the constant high potential, and a drain of the twentieth thin film transistor is coupled to the input of the output buffer module; a gate of the twenty-first thin film transistor is coupled to the second clock signal, and a drain of the twenty-first thin film transistor is coupled to the input end of the output buffer module, and a source of the twenty-first thin film transistor is coupled to a drain of the twenty-second thin film transistor; a gate of the twenty-second thin film transistor is coupled to the first node in the current stage, and a source of the twenty-second thin film transistor is coupled to the constant low potential.

7. The gate driving circuit of the irregular screen panel according to claim 1, wherein a first clock signal and a second clock signal have a same period, and a phase difference of the first clock signal and the second clock signal is a half period.

* * * * *